US007118208B2

(12) United States Patent
Nebashi et al.

(10) Patent No.: US 7,118,208 B2
(45) Date of Patent: Oct. 10, 2006

(54) PRINTER

(75) Inventors: Mitsuhiko Nebashi, Nagano (JP); Motoyoshi Shirotori, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/231,881

(22) Filed: Sep. 22, 2005

(65) Prior Publication Data

US 2006/0028522 A1 Feb. 9, 2006

Related U.S. Application Data

(63) Continuation of application No. 10/612,286, filed on Jul. 3, 2003, now Pat. No. 6,964,475.

(30) Foreign Application Priority Data

Jul. 4, 2002 (JP) ..... P2002-196464

(51) Int. Cl.
*B41J 2/01* (2006.01)

(52) U.S. Cl. ..... 347/101; 347/104; 347/1

(58) Field of Classification Search ..... 347/101, 347/104, 105, 1, 4, 100; 400/621, 613; 101/287
See application file for complete search history.

(56) References Cited

U.S. PATENT DOCUMENTS

| | | | | |
|---|---|---|---|---|
| 4,909,645 | A | 3/1990 | Sudo et al. | |
| 5,779,371 | A | 7/1998 | Aoyama et al. | |
| 5,902,059 | A | 5/1999 | Asai et al. | |
| 6,014,921 | A | 1/2000 | Angel et al. | |
| 6,350,005 | B1 | 2/2002 | Asai et al. | |
| 6,523,927 | B1 | 2/2003 | Asai et al. | |
| 6,964,475 | B1 * | 11/2005 | Nebashi et al. | 347/101 |

FOREIGN PATENT DOCUMENTS

| | | |
|---|---|---|
| EP | 0 765 761 | 4/1997 |
| EP | 0 853 003 | 7/1998 |
| EP | 0 895 868 | 2/1999 |
| EP | 1 080 927 | 3/2001 |
| JP | 6-79855 | 10/1994 |
| JP | 9-95024 | 4/1997 |
| JP | 10-193710 | 7/1998 |
| JP | 11-129551 | 5/1999 |
| JP | 11-157107 | 6/1999 |

* cited by examiner

*Primary Examiner*—Manish S. Shah
(74) *Attorney, Agent, or Firm*—Nixon & Vanderhye P.C.

(57) ABSTRACT

A first frame supports one of a platen and a dot-impact type print head. A second frame supports the other one of the platen and the print head. The second frame is supported by the first frame so as to be pivotable between a first position and a second position. The first position is a position where the print head opposes the platen to define a printing position at which printing is performed on a printing medium through an ink ribbon which are placed between the print head and the platen. The second position is a position where the print head and the platen are not opposed to each other. The printing medium which has been passed through the printing position is discharged from a discharge port. A first path for guiding the printing medium is defined by a first member provided on the first frame and a second member provided on the second frame so as to extend through the printing position to the discharge port, in a case where the second frame is placed at the first position. A second path for guiding the ink ribbon to be placed at the printing position is defined by a third member and a fourth member provided on the first frame so as to branch from a downstream portion of the printing position.

5 Claims, 6 Drawing Sheets

PRINTER

This application is a continuation of U.S. patent application Ser. No. 10/612,286, filed Jul. 3, 2003, now U.S. Pat. No. 6,964,475; which claims priority of Japanese Patent Application No. 2002-196464, filed Jul. 4, 2002, the entire contents of which are hereby incorporated by reference in this application.

BACKGROUND OF THE INVENTION

The present invention relates to a printer capable of opening a sheet guiding path passing through the printing position of a print head. More particularly, the invention relates to a printer in which a sheet feeding mechanism and a sheet cutting mechanism can be properly provided by devising a mechanism for opening the sheet guiding path.

One type of printer for carrying out printing over a rolled sheet is mounted on a POS (point of sales) terminal. In the related art, there is known a printer for carrying out the printing over a rolled sheet having a structure in which a platen opposed to a print head can also be opened together with a cover for opening a sheet holder formed on a printer body in such a manner that a rolled sheet can be exchanged or loading of the rolled sheet can easily be performed. When the platen is opened together with the cover, a sheet guiding path between the print head and the platen is brought into an open state. Consequently, a sheet drawn out of the loaded rolled sheet is disposed along the print head. Then, when the cover is closed, it is possible to automatically bring a state in which the rolled sheet is interposed between the print head and the platen and is thus drawn out.

For example, Japanese Patent Publication No. 6-79855B (63-98451A) discloses such a rolled sheet printer. In the printer, a platen roller pushed against a thermal head is also attached to the tip of a cover for a sheet holder. In a state in which the cover is closed, the platen roller is protruded toward the thermal head side through an opening portion formed in the sheet holder and is thus pushed against thermal head. When the cover is opened, the platen roller also goes away from the thermal head. Consequently, the lead out portion of the rolled sheet is easily disposed between the platen roller and thermal head. When the cover is then closed, a state in which the rolled sheet is interposed between the thermal head and the platen roller is automatically established.

In the case in which the print head has a dot impact system or an ink jet system, the platen is provided in parallel with the print head while defining a gap therebetween.

In case of a mechanism for opening and closing a platen together with the cover of a sheet holder, it is necessary to carry out a component layout in such a manner that other components are not positioned on the moving loci of the cover and the platen. In the rolled sheet, particularly, an automatic cutting mechanism for cutting a sheet obtained after printing is mounted in many cases. In general, the automatic cutting mechanism is provided on a discharge port of the printed sheet which is formed on the upper face of the printer. In this case, a printing position is placed just below the discharge port, and the cutting mechanism is positioned on the moving locus of the platen defining the printing position. For this reason, it is necessary to devise the moving locus of the platen or the arrangement position and structure of the cutting mechanism.

In the case in which a platen roller is to be pushed against the head face of a thermal head, moreover, it is sufficient that the platen roller is pushed against thermal head in the closure of the cover to move the thermal head backward supported by a spring member. Accordingly, there is no problem even if the moving locus of the platen and a print head cross each other.

In case of a non-contact type print head having the dot impact system or the ink jet system, it is necessary to place the platen in a parallel state in which it is opposed to a head face of the print head while defining a gap therebetween. In this case, it is necessary to constitute the opening mechanism of the platen in such a manner that the moving locus of the platen and the print head do not cross each other.

In case of the print head having the dot impact system, furthermore, it is necessary to attach a ribbon cassette accommodating an ink ribbon to the print head portion. The ribbon cassette is generally attached to establish a state in which the ink ribbon is inserted between the print head and the platen from just above the print head. In the case in which the automatic cutting mechanism of the sheet is provided just above the print head, the automatic cutting mechanism becomes an obstacle so that the ribbon cassette cannot be attached at a touch. For this reason, it is necessary to carry out an operation for once retreating the automatic cutting mechanism together with the cover.

SUMMARY OF THE INVENTION

It is therefore an object of the invention to provide a printer capable of opening and closing a platen opposed to a print head while defining a gap therebetween without interfering with a sheet cutting mechanism or a print head.

It is also an object of the invention to provide a printer capable of forming a space for arranging components of a sheet cutting mechanism and a feeding mechanism just above a print head in such a manner as to not reach the moving locus of a platen to be opened and closed.

It is also an object of the invention to provide a printer comprising a print head having a dot impact system which can attach and remove a ribbon cassette at a touch without carrying out an operation for retreating an automatic sheet cutting mechanism.

In order to achieve the above objects, according to the invention, there is provided a printer, comprising:

a platen;

a dot-impact type print head;

a first frame, which supports one of the platen and the print head;

a second frame, which supports the other one of the platen and the print head, the second frame being supported by the first frame so as to be pivotable between a first position and a second position, the first position being a position where the print head opposes to the platen to define a printing position at which printing is performed on a printing medium through an ink ribbon which are placed between the print head and the platen, the second position being a position where the print head and the platen are not opposed to each other;

a discharge port, from which the printing medium which has been passed through the printing position is discharged;

a first member, provided on the first frame;

a second member, provided on the second frame;

a first path, for guiding the printing medium, the first path defined by the first member and the second member so as to extend through the printing position to the discharge port, in a case where the second frame is placed at the first position;

a third member, provided on the first frame;

a fourth member, provided on the first frame; and a second path, for guiding the ink ribbon to be placed at the printing position, the second path defined by the third member and the fourth member so as to branch from a downstream portion of the printing position in the first path.

In such a configuration, it is possible to simply pivot the second frame, thereby opening the first path without influencing the second path. Accordingly, the second path is provided on the outside of the pivoting loci of the second frame as seen from the side of the printer. By utilizing a space between the first path and the second path, it is possible to arrange the components of a cutting mechanism and a feeding mechanism for the printing medium. Thus, the size of the printer can be reduced.

Moreover, since the platen and the print head do not cross each other when the second frame is pivoted, it is possible to easily implement a platen opening and closing mechanism suitable for a printer comprising a print head having a dot impact system or an ink jet system in which the platen is to be opposed to the print head at a predetermined interval.

Furthermore, since the attachment and removal of the ink ribbon cassette does not interfere with the cutting mechanism and the feeding mechanism, it is possible to attach and remove the ribbon cassette at a touch without moving the cutting mechanism or the like.

Preferably, the printer further comprises an automatic cutting mechanism, which comprises:

a first blade, placed between the first path and the second path;

a second blade, provided on the second frame; and a driving mechanism, operable to move the second blade relative to the first blade to cut the printing medium placed between the first blade and the second blade.

In such a configuration, it is possible to set the printing medium between the first blade and the second blade by merely drawing the printing medium out of the printing section and pivoting the second frame to the first position.

Preferably, the printer further comprises a pair of rollers which feed the printing medium held therebetween to the discharge port. One of the rollers is provided on the second frame, and the other one of the rollers is placed between the first path and the second path.

In such a configuration, it is possible to interpose the printing medium between the rollers by simply pivoting the second frame to the first position under a condition that the printing medium is drawn out from the printing section.

Here, it is preferable that the first blade is disposed closer to the discharge port than the rollers.

Preferably, the printer further comprises: a holder, provided in the first frame to hold a rolled printing medium therein; and a cover, provided on the second frame to open or close the holder.

Here, it is preferable that the first path extends from the holder such that the first path is also opened in a case where the second frame is placed at the second position.

According to the invention, there is also provided a printer, comprising:

a platen;

a print head, having a head face directed obliquely upward;

a first frame, which supports one of the platen and the print head; and a second frame, which supports the other one of the platen and the print head, the second frame being supported by the first frame so as to be pivotable between a first position and a second position, the first position being a position where the print head opposes to the platen in parallel, to define a printing position at which printing is performed on a printing medium placed between the print head and the platen, the second position being a position where the print head and the platen are not opposed to each other, wherein a pivot center of the second frame is placed lower than the head face.

In such a configuration, when the platen is moved from a position opposed to the print head, the moving locus of the platen is not turned forward but rearward away from the head face of the print head. As seen from the side of the printer, accordingly, a space which does not reach the moving locus of the platen is formed just above the print head and the platen. By utilizing the space, therefore, it is possible to arrange the components of the cutting mechanism and the feeding mechanism for the printing medium. Consequently, the size of the printer can be reduced.

According to the invention, there is also provided a printer, comprising:

a platen;

a print head;

a first frame, which supports one of the platen and the print head;

a second frame, which supports the other one of the platen and the print head, the second frame being supported by the first frame so as to be pivotable between a first position and a second position, the first position being a position where the print head opposes to the platen to define a printing position at which printing is performed on a printing medium placed between the print head and the platen, the second position being a position where the print head and the platen are not opposed to each other;

a discharge port, from which the printing medium which has been passed through the printing position is discharged;

a first member, provided on the first frame;

a second member, provided on the second frame;

a first path, for guiding the printing medium therethrough, the first path defined by the first member and the second member so as to extend through the printing position to the discharge port, in a case where the second frame is placed at the first position;

a third member, provided on the first frame;

a fourth member, provided on the first frame; and a second path, for guiding the printing medium therethrough, the second path defined by the third member and the fourth member so as to branch from a downstream portion of the printing position in the first path.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
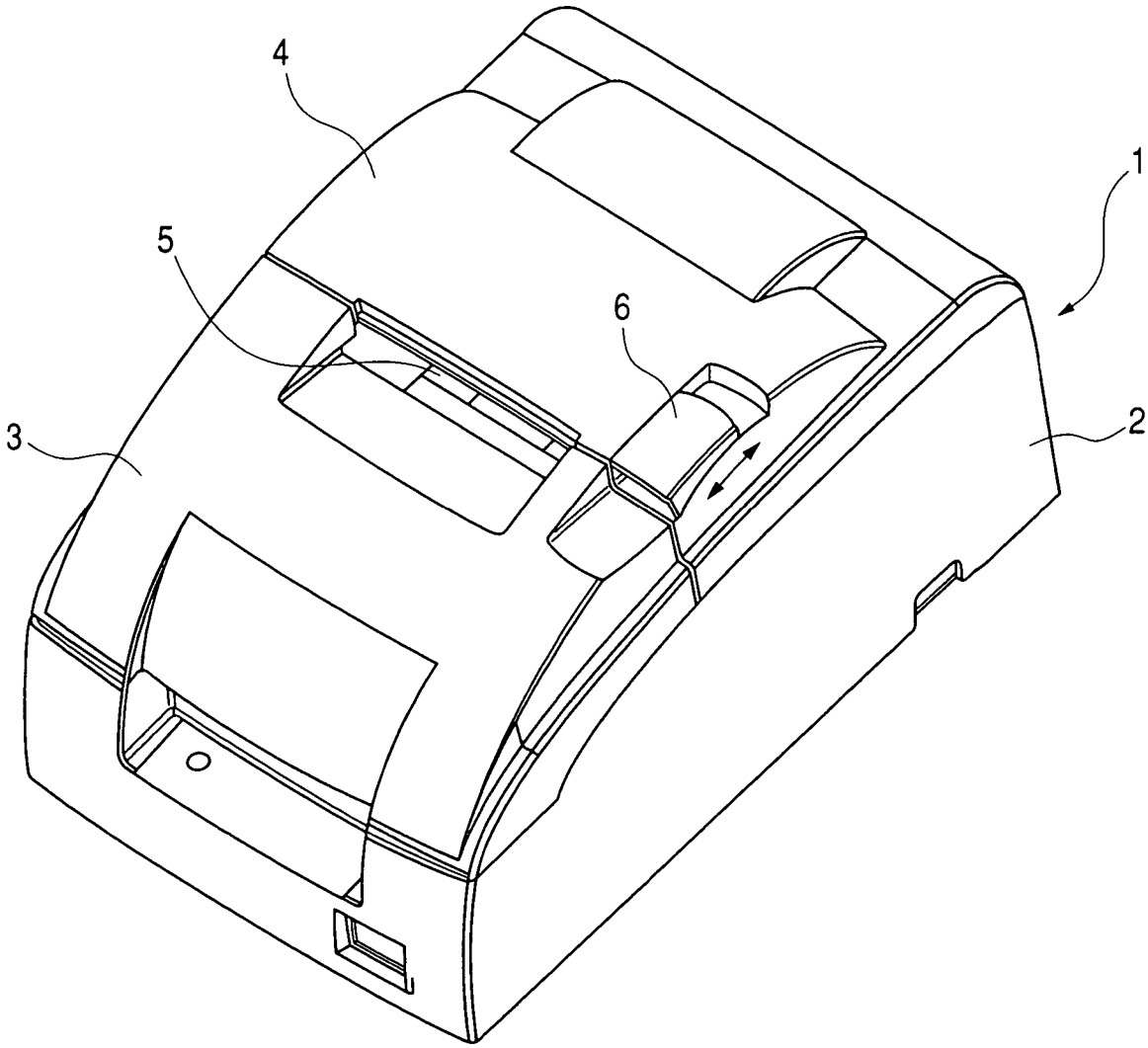
FIG. 1 is a perspective view showing the appearance of a printer according to one embodiment of the invention.

One embodiment of the invention will be described below with reference to the accompanying drawings.

A printer 1 comprises a rectangular frame-shaped casing body 2 defining a periphery thereof; and front and rear covers 3 and 4 covering the front and rear portions of the upper face of the printer 1, and these constitute a printer casing. A discharge port 5 is formed in a position between the front and rear covers 3 and 4. The rear cover 4 can be opened by operating a slide button 6. When the cover 4 is opened, a sheet holder 8 is exposed to exchange a rolled sheet 7. Moreover, when the front cover 3 supported pivotably about a support hole 40*a* provided on a lower end at the front side of a body frame 40 (see FIG. 2) is opened, a ribbon cassette holder 10 to which an ink ribbon cassette 9 is removably attached is exposed so that an exchanging operation of the ribbon cassette 9 can be performed.

Figure 2:
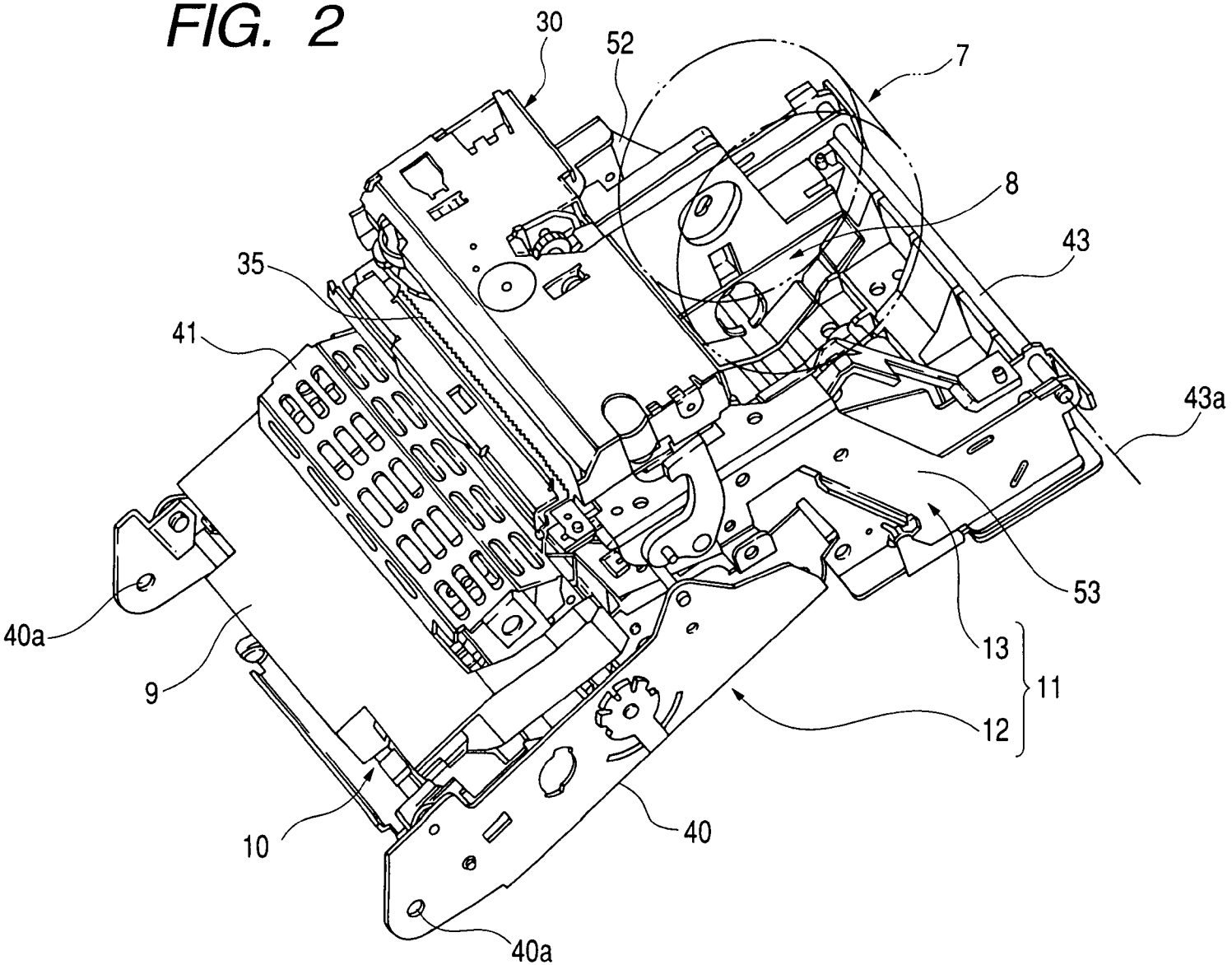
FIG. 2 is a perspective view showing a printer unit provided in the printer.

A printer unit 11 shown in FIG. 2 is disposed in the printer casing constituted by the casing body 2, and the front and rear covers 3 and 4. The printer unit 11 comprises a fixed unit 12 and a movable unit 13, and a rear end portion of the movable unit 13 is supported by the fixed unit 12 so as to be pivotable vertically.

Figure 4:
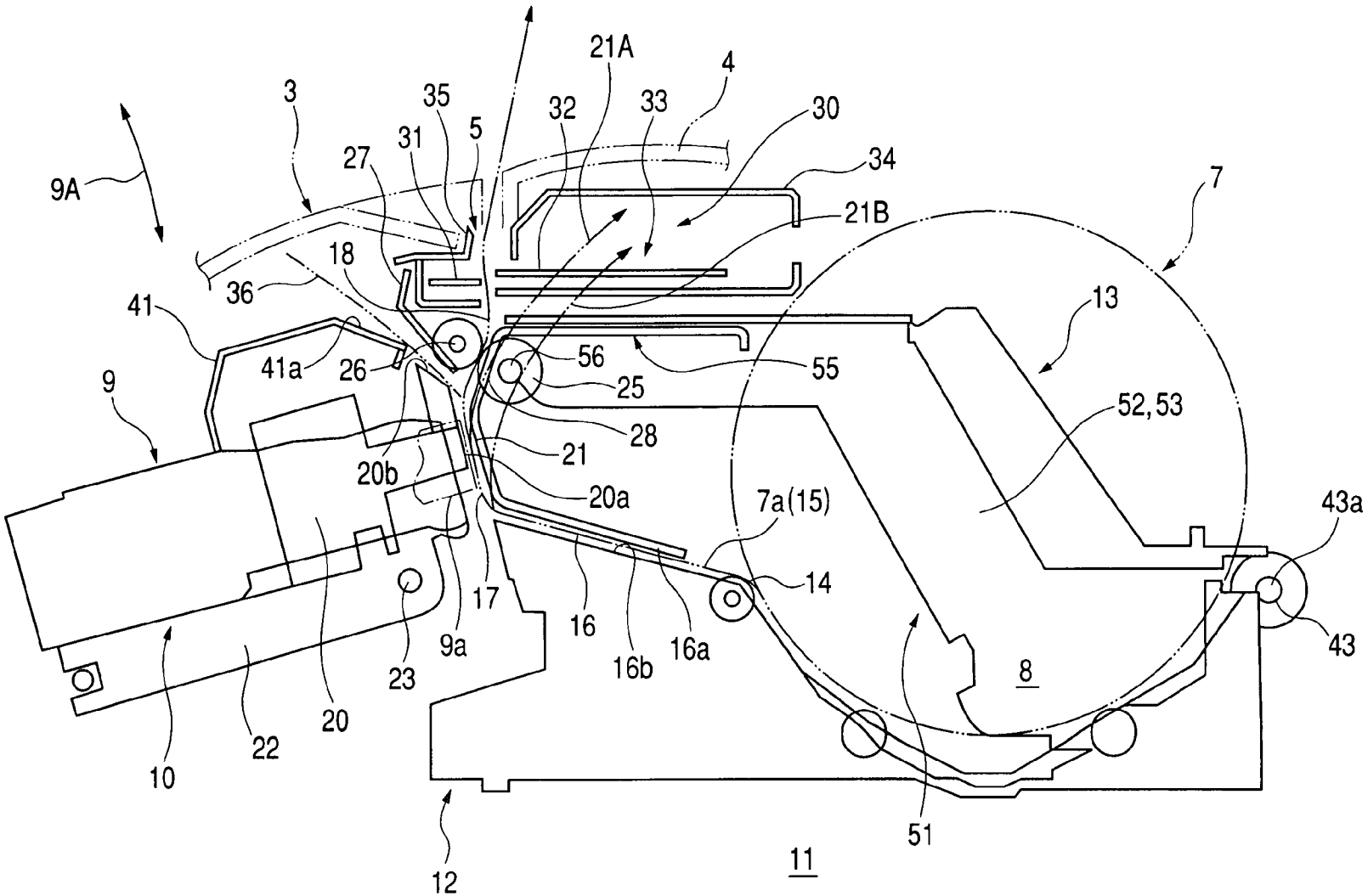
FIG. 4 is a side section view of the printer unit, showing a condition that a cover is closed.

With reference to FIG. 4 mainly, the whole structure of the printer unit 11 will be described. A rear portion of the printer unit 11 is provided with the sheet holder 8 having an arcuate section which is opened upward as seen from a side view. A sheet 7*a* drawn out of the rolled sheet 7 which is loaded in the sheet holder 8 is guided to a first sheet guiding path 15 through a guide roller 14 provided in the front end portion of the sheet holder 8. The first sheet guiding path 15 includes a first path section 16 which is gently sloped upward and forward; a second path section 17 which is steeply sloped upward and forward from the front end of the first path section 16; and a third path section 18 which is sloped upward and rearward from the upper end of the second path section 17 and is connected to the discharge port 5. In FIG. 4, the sheet 7*a* and the first sheet guiding path 15 are shown in a two-dotted chain line.

The first path section 16 is defined by a guide member 16*a* and a guide face 16*b* opposed thereto. The second path section 17 connected thereto is defined by a head face 20*a* of a print head 20 having a dot impact system and a platen section 21 opposed thereto at a regular interval to define a printing position of the print head 20.

Figure 5:
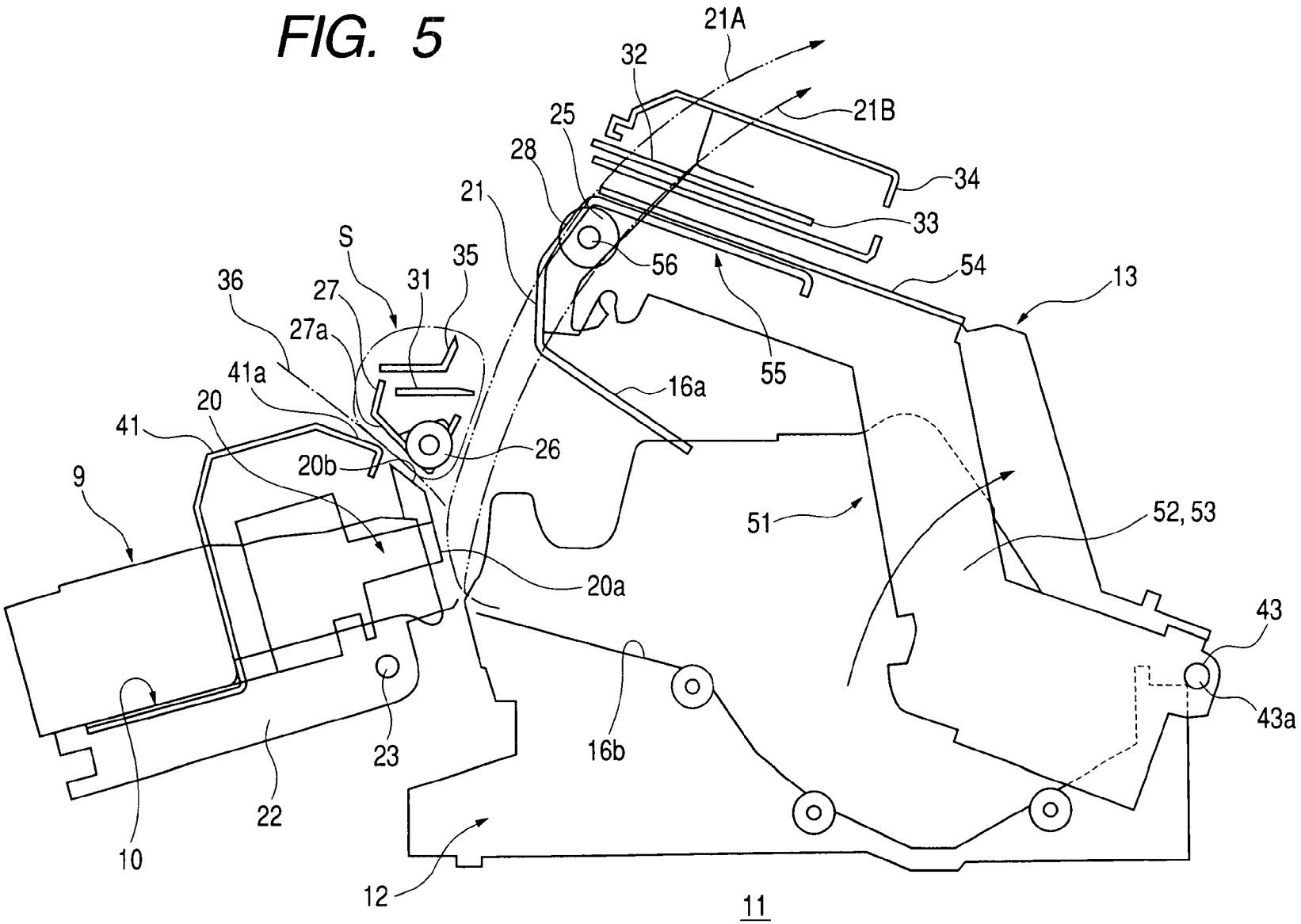
FIG. 5 is a side section view of the printer unit, showing a condition that the cover is opened halfway.

In a place in which the printing position of the first sheet guiding path 15 is passed and the course is changed toward the rear side, a second sheet guiding path 36 extending obliquely upward and forward is formed. One side of the second sheet guiding path 36 is defined by a slope face 41*a* of a ribbon frame 41 which will be described later and a head guide face 20*b* of the print head 20, and the other side is defined by a guide face 27*a* of a roller holding plate 27 fixed to the body frame and a press roller 26. In FIGS. 4 and 5, the second sheet guiding path 36 is shown in a chain line. As in the embodiment, it is desirable that the crossing section of the first sheet guiding path 15 and the second sheet guiding path 36 should be almost Y-shaped as seen from the side. By this structure, a sheet passing through the second sheet guiding path 36 can easily be guided to the printing position and can be fed naturally in the first sheet guiding path 15.

The print head 20 is disposed in such a manner that the head face 20*a* is directed rearward and upward. Corresponding to the inclination of the print head 20, the surface of the platen section 21 is directed forward and downward. The print head 20 is mounted on a head carriage 22, and the head carriage 22 can be reciprocated in a transverse direction along a carriage guide shaft 23.

Figure 3:
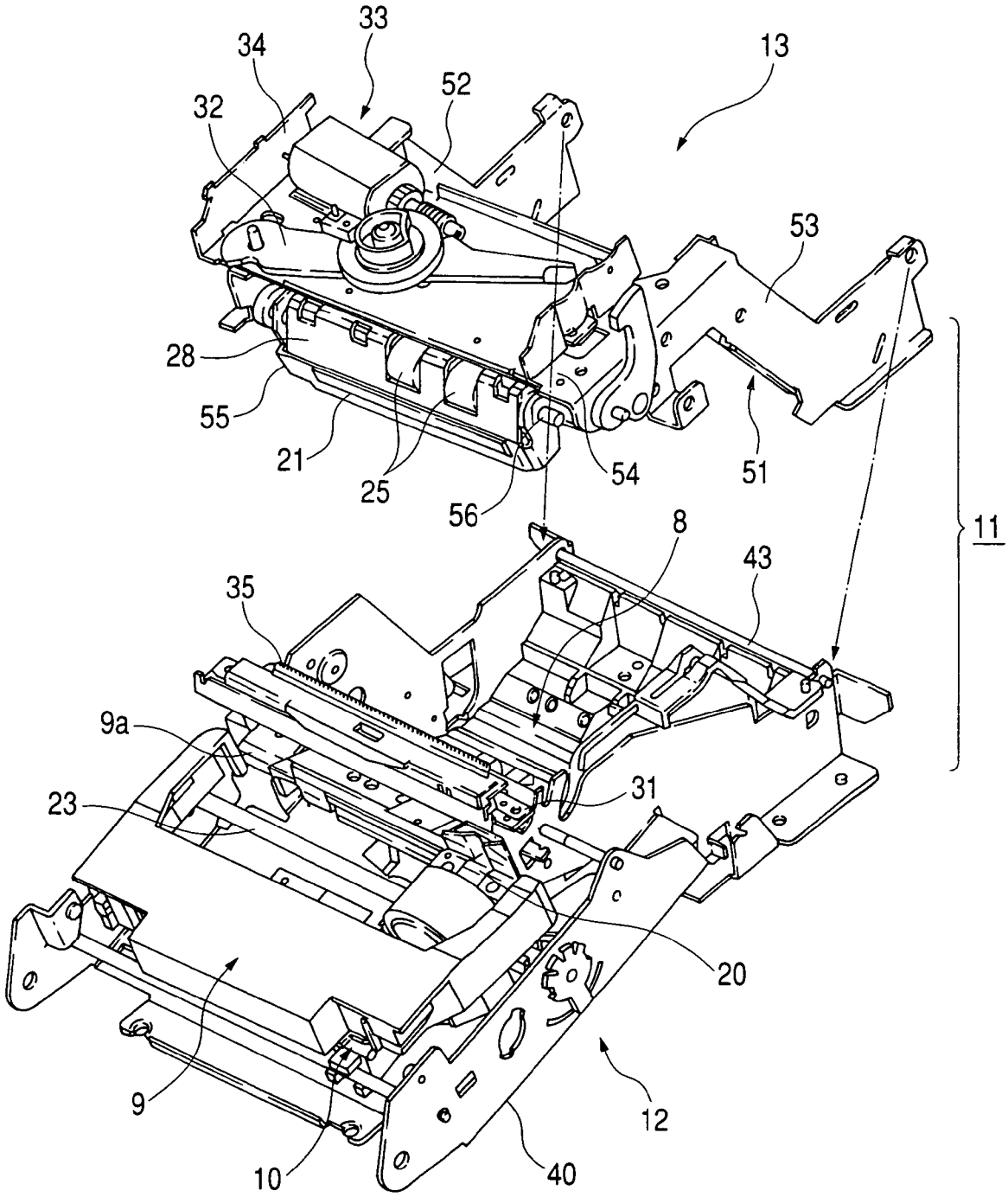
FIG. 3 is an exploded perspective view showing a state in which a movable unit is removed from a fixed unit constituting the printer unit.

The ribbon frame 41 is attached in such a state as to cover the head carriage 22 and the print head 20, and the ribbon cassette holder 10 is formed in the outer peripheral portion of the ribbon frame 41. In FIG. 3, the ribbon frame 41 is omitted. The ribbon cassette holder 10 is inclined such that an upper face thereof is directed forward and upward.

Accordingly, an ink ribbon 9*a* of the ribbon cassette 9 attached to the ribbon cassette holder 10 is moved through the second sheet guiding path 36 and can be set between the print head 20 and the platen section 21 in parallel therewith.

The third path section 18 connected to the second path section 17 is defined by a guide member 28 extending rearward from the upper end of the platen section 21. In the third path section 18, there are disposed a feeding roller 25 and the press roller 26 elastically abutted against the feeding roller 25. The feeding roller 25 is provided on the rear side of the third path section 18 and the press roller 26 is supported movably in such a direction as to approach the feeding roller 25. The press roller is always urged toward the feeding roller 25 by the elastic force of a leaf spring or a wire spring. The sheet 7*a* drawn out of the rolled sheet 7 is interposed between the feeding roller 25 and the press roller 26 and a driving source (not shown) rotates the feeding roller 25 so that the sheet 7*a* is fed along the first sheet guiding path 15. In the embodiment, the platen section 21 and the guide members 16*a*, 28 continued from upper and lower portions of the platen section 21 constitute a platen frame 55 as a single component.

An automatic sheet cutting unit 30 is provided in the vicinity of the discharge port 5. The automatic sheet cutting unit 30 includes a fixed blade 31 placed in the front side of the first sheet guiding path 15; a movable blade 32 placed in the rear side of the first sheet guiding path 15; and a driving mechanism 33 for actuating the movable blade 32. The movable blade 32 and the driving mechanism 33 are provided in a casing 34. The movable blade 32 slides over the upper face of the fixed blade 31 so that the sheet 7*a* disposed therebetween is cut. Moreover, a blade 35 capable of manually cutting the sheet is attached to the front edge portion of the discharge port 5.

The printer unit 11 according to the embodiment is constituted such that the first sheet guiding path 15 having the structure described above is also brought into an open state when the cover 4 for the sheet holder 8 is opened in order to easily replace the rolled sheet 7. For this purpose, components on one of sides constituting the first 5 sheet guiding path 15 are attached to the fixed unit 12, and the cover 4 and components on the other side constituting the first sheet guiding path 15 are attached to the movable unit 13. When the movable unit 13 is opened, the sheet holder 8 is opened, and at the same time, the first sheet guiding path 15 is also opened.

More specifically, the sheet holder 8, the guide face 16*b* of the first path section 16, the print head 20, the press roller 26 and the fixed blade 31 of the automatic sheet cutting unit 30 are attached to the fixed unit 12. On the other hand, the platen frame 55 (the guide member 16*b*, the platen section 21 and the guide member 28 defining the first path section 16, the second path section 17 and the third path section 18 respectively), the feeding roller 25, and the movable blade 32 and the driving mechanism 33 of the automatic sheet cutting unit 30 are attached to the movable unit 13. Moreover, the cover 4 is also attached.

By this structure, even if the movable blade 32 is brought into a disconnection state for some failure, that is, the stoppage is carried out in the crossing state of the movable blade 32 and the fixed blade 31, the movable unit 13 can be moved because the movable blade 32 is positioned on the upper side of the fixed blade 31.

Figure 6:
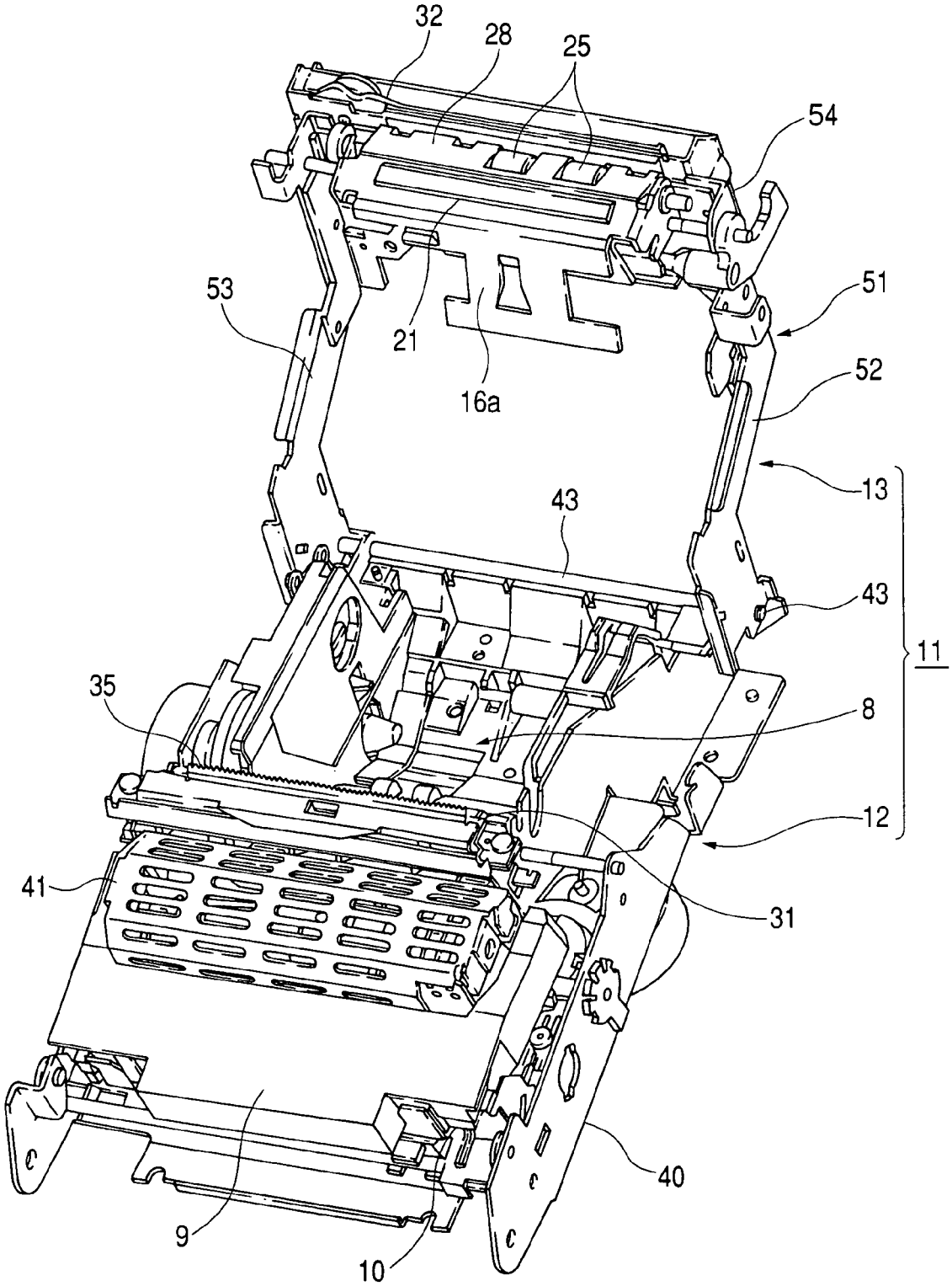
FIG. 6 is a perspective view of the printer unit, showing a condition that the movable unit is opened completely.

As is apparent from FIGS. 5 and 6, when the movable unit 13 is opened, the rolled sheet 7 can be loaded by a simple operation of dropping the rolled sheet 7 into the sheet holder 8 from above. Moreover, since the first sheet guiding path 15 is set in the open state, an operation for arranging the sheet 7*a* drawn out of the rolled sheet 7 along the first sheet guiding path 15 is also carried out very easily. When the movable unit 13 is closed and is returned into the state shown in FIGS. 2 and 4, there is automatically brought about a state in which the sheet 7*a* is drawn out of the discharge port 5 through a portion between the print head 20 and the platen section 21 and a portion between the feeding roller 25 and the press roller 26.

Next, the structures of the fixed unit 12 and the movable unit 13 will be described in more detail. The fixed unit 12 including the body frame 40 and the carriage guide shaft 23 is provided in a transverse direction over the front part of the body frame 40. The head carriage 22 mounting the print head 20 thereon is supported on the carriage guide shaft 23 in a reciprocatable state as described above. Moreover, the ribbon frame 41 is attached to the body frame 40.

The sheet holder 8 is formed in the rear part of the body frame 40 and a pivot shaft 43 extending in a transverse direction is provided over the body frame 40 in the rear end portion of the sheet holder 8. The pivot shaft 43 serves as a pivot center of the movable unit 13.

On the other hand, the movable unit 13 has a cover frame 51. The cover frame 51 has left and right arm sections 52 and 53 extending in a longitudinal direction and a plate section 54 connecting the front end portions of the arm sections 52 and 53. The rear end portions of the left and right arm sections 52 and 53 are pivotably supported by both end portions of the pivot shaft 43. The platen frame 55 is attached to the front end of the plate section 54 of the cover frame 51, and a feeding roller shaft 56 is attached to the back side of the platen frame 55. The outer peripheral faces of two feeding rollers 25 fixed coaxially to the feeding roller shaft 56 are protruded forward from an opening formed on the guide member 28 in the platen frame 55. The movable blade 32 and the driving mechanism 33 in the automatic sheet cutting unit 30 are mounted horizontally on the plate section 54 of the cover frame 51.

As is apparent from FIG. 4, in the fixed unit 12, the print head 20 is inclined so that the head face 20*a* is directed upward and rearward, and correspondingly, the ribbon cassette 9 attached to the ribbon cassette holder 10 is inclined so that a top face thereof is directed upward and forward. On the movable unit 13 side, the platen section 21 is directed forward and downward to be opposed in parallel with the head face 20*a* of the print head 20 at a regular interval. The pivot center of the movable unit 13, that is, the height position of a center axis 43*a* of the pivot shaft 43 is set to be placed on the lower side than the head face 20*a* of the print head 20.

As a result, the moving loci of tip portions of the movable unit 13, that is, the moving loci of the upper and lower ends of the platen section 21 opposed to the print head 20 are shown in imaginary lines 21A and 21B of FIGS. 4 and 5. The moving loci 21A and 21B are circular arcs which are not turned forward or upward with respect to the head face 20*a* of the print head 20, but go away rearward from a position opposed to the print head 20 (a position in which the movable unit 13 is closed), and these moving loci 21A and 21B do not intersect the print head 20 when the movable unit 13 is opened.

Moreover, since the pivot center 43*a* of the movable unit 13 is positioned on the lower side than the head face 20*a* of the print head 20, the amounts of rearward movement of the moving loci 21A and 21B obtained with the movement of the movable unit 13 are large.

Furthermore, since the ribbon cassette holder 10 is inclined as described above, the ribbon cassette 9 can be attached and removed in an oblique direction (directions indicated by arrows 9A shown in FIG. 4) from the forward and upper side which is an almost vertical direction with respect to the ribbon cassette holder 10. As a result, a space S, which neither reaches the moving locus of the movable unit 13 nor obstructs the movement of the ribbon in the attachment and removal of the ribbon cassette 9, is formed just above the print head 20 as shown in FIG. 5. In the embodiment, the press roller 26 and the fixed blade 31 of the automatic sheet cutting unit 30 are provided by utilizing the space.

By the structure, the press roller 26 and the fixed blade 31 of the automatic sheet cutting unit 30 are provided just above the print head 20. However, these do not disturb the attachment and removal of the ribbon cassette 9. Accordingly, there is an advantage that the attachment and removal of the ribbon cassette 9 can be carried out at a touch. Moreover, the space S is used efficiently and practically. Consequently, the size of the printer can be reduced.

By adjusting at least one of the inclination angles of the print head 20 and the platen section 21 and the height position of the pivot center 43*a* of the movable unit 13, the moving locus of the movable unit 13 can be changed. Consequently, there is also an advantage that it is possible to increase or decrease the space S which is formed just above the print head 20 and does not reach the moving locus, resulting in an increase in the degree of freedom of a component layout.

While the embodiment relates to the printer comprising the print head 20 of a dot impact type, the invention can also be applied to a printer using an ink jet head as a print head. Furthermore, it is also possible to apply the invention to a printer using a contact type such as a thermal head for a print head.

While the description has been given to the embodiment by using the example in which the automatic cutting mechanism and the feeding mechanism are provided on the upper side of the print head, only the automatic cutting mechanism may be provided on the upper side of the print head and the feeding mechanism may be provided on the lower side of the print head (the upstream side of the first sheet guiding path 15).

Moreover, while the second sheet guiding path 36 causes the ribbon of the ribbon cassette 9 to pass therethrough in the embodiment, it is also possible to employ such a structure that the cover 3 is provided with a slit capable of inserting a cut sheet over the extension of the second sheet guiding path 36 in a different position from the discharge port 5 so that the cut sheet is inserted from the slit into the printing position to carry out validation printing, for example. In that case, when being inserted through the slit, the sheet passes through the second sheet guiding path 36 and the printing position and a tip of the cut sheet abuts on a regulating section 12*a* of the fixed unit 12. Thus, the second sheet guiding path can serve as a path for the movement of the ink ribbon and the cut sheet. Consequently, it is possible to provide a printer having a small size and an excellent operability.

Moreover, while the press roller 26 is provided in the space S in the embodiment, a feeding roller may be provided in place of the press roller and the press roller may be provided on the cover frame 51. In this case, there is an advantage that a gear train for driving the roller can easily be designed because the driving side is a body frame which is not moved.

Furthermore, while the description has been given to the embodiment by using the example in which the platen section 21 is supported on the cover frame 51 and the print head 20 is supported on the body frame 40, the platen may be supported on the body frame 40 and the print head 20 may be supported on the cover frame 51. In consideration of the control cable of the print head, the configuration of the embodiment is preferable.

The platen may be plate-shaped or may be of a roller type.

What is claimed is:

1. A printer, comprising:

a platen;

a print head having a head face directed obliquely upward;

a first frame supporting the print head; and a second frame supporting the platen and being supported by the first frame so as to be pivotable between a first position and a second position, the first position being a position where the print head opposes the platen in parallel to define a printing position at which printing is performed on a printing medium placed between the print head and the platen, the second position being a position where the print head and the platen are not opposed to each other, wherein a pivot center of the second frame is placed lower than the head face.

2. The printer as set forth in claim 1, wherein the printing medium follows one of a first path and a second path downstream of the print head, the printer further comprising an automatic cutting mechanism, comprising:

a first blade placed between the first path and the second path;

a second blade provided on the second frame; and a driving mechanism operable to move the second blade relative to the first blade to cut the printing medium placed between the first blade and the second blade.

3. The printer as set forth in claim 1, wherein the printing medium follows one of a first path and a second path downstream of the print head, the printer further comprising a pair of rollers which feed the printing medium held therebetween to a discharge port, wherein one of the rollers is provided on the second frame, and the other one of the rollers is placed between the first path and the second path.

4. The printer as set forth in claim 1, further comprising:

a holder provided in the first frame to hold a rolled printing medium therein; and a cover provided on the second frame to open or close the holder.

5. The printer as set forth in claim 4, wherein the printing medium follows one of a first path and a second path downstream of the print head, and wherein the first path extends from the holder such that the first path is also opened when the second frame is placed at the second position.

* * * * *